US011227511B2

(12) United States Patent
Enriquez et al.

(10) Patent No.: US 11,227,511 B2
(45) Date of Patent: Jan. 18, 2022

(54) POP-UP DISPLAY AND POP-UP DISPLAY LOCKING MECHANISM THEREFORE

(71) Applicant: R. R. Donnelley & Sons Company, Chicago, IL (US)

(72) Inventors: Carlos Enriquez, Pleasant Prairie, WI (US); Mitchell Miller, Milwaukee, WI (US)

(73) Assignee: R. R. Donnelley & Sons Company, Chicago, IL (US)

( * ) Notice: Subject to any disclaimer, the term of this patent is extended or adjusted under 35 U.S.C. 154(b) by 424 days.

(21) Appl. No.: 16/323,331

(22) PCT Filed: Aug. 4, 2017

(86) PCT No.: PCT/US2017/045471
§ 371 (c)(1),
(2) Date: Feb. 5, 2019

(87) PCT Pub. No.: WO2018/027118
PCT Pub. Date: Feb. 8, 2018

(65) Prior Publication Data

US 2021/0233432 A1 Jul. 29, 2021

Related U.S. Application Data

(60) Provisional application No. 62/371,537, filed on Aug. 5, 2016.

(51) Int. Cl.
*G09F 1/06* (2006.01)
*G09F 1/10* (2006.01)

(52) U.S. Cl.
CPC ..... *G09F 1/065* (2013.01); *G09F 1/10* (2013.01)

(58) Field of Classification Search
CPC ..... G09F 3/14; G09F 3/0295
See application file for complete search history.

(56) References Cited

U.S. PATENT DOCUMENTS 1,028,147 A 6/1912 Stranders
1,670,464 A 12/1923 Marsh
(Continued)

FOREIGN PATENT DOCUMENTS

CN 1387175 12/2002
CN 101473360 7/2009
(Continued)

OTHER PUBLICATIONS

United States Patent and Trademark Office, "Non-Final Office Action," issued in connection with U.S. Appl. No. 14/709,266, dated May 23, 2016, 11 pages.
(Continued)

*Primary Examiner* — Cassandra Davis
(74) *Attorney, Agent, or Firm* — Hanley, Flight & Zimmerman, LLC

(57) ABSTRACT

Erectable displays and methods of making such erectable displays are disclosed. An example apparatus includes a display apparatus including a shroud having a first sheet and a second sheet disposed in opposition to one another, the first sheet and the second sheet being connected to one another at a first end by a first joint and at a second end by a second joint. The display apparatus includes at least one support member disposed between the first and second sheets and between the first and second joints, the support member(s) being configured to outwardly bias the first and second sheets to cause the shroud to assume a curvilinear cross-sectional shape along at least a portion of a longitudinal axis of the shroud.

16 Claims, 16 Drawing Sheets

(56) References Cited

U.S. PATENT DOCUMENTS

| | | | |
|---|---|---|---|
| 1,545,771 | A | 7/1925 | Int |
| 1,576,672 | A | 3/1926 | Miller |
| 1,656,341 | A | 1/1928 | Smith |
| 1,687,616 | A | 10/1928 | Huye |
| 1,902,566 | A | 3/1933 | Marsh |
| 2,108,349 | A | 2/1938 | Rasmussen |
| 2,113,288 | A | 4/1938 | Berger |
| 2,142,826 | A | 1/1939 | Rosello |
| 2,153,460 | A | 4/1939 | Giles |
| 2,210,317 | A | 8/1940 | Dueringer |
| 2,283,406 | A | 5/1942 | Bacon |
| 2,290,144 | A | 7/1942 | Katz |
| 2,404,089 | A | 7/1946 | Pollock |
| 2,601,374 | A | 6/1952 | Ditzler et al. |
| 2,637,924 | A | 5/1953 | Hutt |
| 2,728,461 | A | 12/1955 | Paige |
| 2,773,324 | A | 12/1956 | Drueck, Jr. |
| 2,833,074 | A | 5/1958 | Jannes |
| 2,892,276 | A | 6/1959 | Nelson |
| 2,918,178 | A | 12/1959 | Leone |
| 2,984,920 | A | 5/1961 | Acosta et al. |
| 3,015,898 | A | 1/1962 | Keeslar |
| 3,091,877 | A | 6/1963 | Luchsinger |
| 3,234,682 | A | 2/1966 | Frankl |
| 3,267,597 | A | 8/1966 | Jannes |
| 3,302,321 | A | 2/1967 | Walker |
| 3,571,958 | A | 3/1971 | Trevor |
| 3,665,669 | A | 5/1972 | Huber |
| 3,666,607 | A | 5/1972 | Weissman |
| 4,234,148 | A | 11/1980 | Maddestra et al. |
| 4,610,363 | A | 9/1986 | Flum et al. |
| 4,619,426 | A | 10/1986 | Drueck, Jr. |
| 4,750,283 | A | 6/1988 | Halpern |
| 4,770,379 | A | 9/1988 | Estvold |
| 4,773,622 | A | 9/1988 | Herlin |
| 4,774,780 | A | 10/1988 | Crowell |
| 4,790,714 | A | 12/1988 | Schnapp |
| 4,854,060 | A | 8/1989 | Corbo et al. |
| 4,910,899 | A | 3/1990 | Alperin |
| 4,940,199 | A | 7/1990 | Hall |
| 4,984,848 | A | 1/1991 | Scalisi et al. |
| 4,993,846 | A | 2/1991 | Diamond et al. |
| 5,000,717 | A | 3/1991 | Pfeiffer |
| 5,090,349 | A | 2/1992 | Wilson |
| 5,193,466 | A | 3/1993 | Eder |
| 5,197,631 | A | 3/1993 | Mishima |
| 5,297,677 | A | 3/1994 | Burian et al. |
| 5,416,997 | A | 5/1995 | Dyment et al. |
| 5,454,180 | A | 10/1995 | Volpe |
| 5,467,547 | A | 11/1995 | Fortner |
| 5,632,390 | A | 5/1997 | Podergois |
| 5,752,649 | A | 5/1998 | Weder |
| 5,758,438 | A | 6/1998 | Crowell |
| 5,778,959 | A | 7/1998 | Guetschow |
| 5,787,621 | A | 8/1998 | Leksell |
| 5,809,673 | A | 9/1998 | Johnson et al. |
| 5,868,367 | A | 2/1999 | Smith |
| 5,878,945 | A | 3/1999 | Weder |
| 5,937,553 | A | 8/1999 | Maran |
| 5,966,857 | A | 10/1999 | Pettersson et al. |
| 5,983,538 | A | 11/1999 | Crowell |
| 6,311,418 | B1 | 11/2001 | Crowell |
| 6,347,772 | B1 | 2/2002 | L'Hotel |
| 6,497,601 | B1 | 12/2002 | Ward |
| 7,134,230 | B1 | 11/2006 | Boens et al. |
| 7,159,350 | B2 | 1/2007 | L'Hotel |
| 7,234,253 | B2 | 6/2007 | Ossmann |
| 7,437,842 | B2 | 10/2008 | Sgambellone |
| 7,634,865 | B2 | 12/2009 | L'Hotel |
| 7,726,054 | B2 | 6/2010 | Mestres Armengol et al. |
| 7,774,964 | B2 | 8/2010 | L'Hotel |
| 7,980,013 | B2 | 7/2011 | Hsu |
| 7,980,016 | B2 | 7/2011 | L'Hotel |
| 8,099,883 | B2 | 1/2012 | Mestres Armengol et al. |
| 8,112,925 | B2 | 2/2012 | Tzuo |
| 8,228,410 | B2 | 7/2012 | Raynor et al. |
| 8,291,631 | B2 | 10/2012 | Wilder |
| 8,458,939 | B2 | 6/2013 | Arthur et al. |
| 8,590,188 | B2 | 11/2013 | Mirsch |
| 8,701,321 | B2 | 4/2014 | Da Fonseca et al. |
| 8,776,415 | B2 | 7/2014 | Kawaguchi et al. |
| 8,826,833 | B1 | 9/2014 | Fischer et al. |
| 8,863,418 | B2 | 10/2014 | Acker et al. |
| 8,875,908 | B2 | 11/2014 | L'Hotel |
| 9,123,262 | B1 | 9/2015 | Frost |
| 9,173,485 | B2 | 11/2015 | Fischer et al. |
| 9,351,591 | B2 | 5/2016 | Mestres Armengol et al. |
| 9,569,160 | B2 | 2/2017 | Tsuchida et al. |
| 9,715,840 | B1 * | 7/2017 | Warmus ..... G09F 1/065 |
| 10,008,138 | B2 | 6/2018 | Bonifas |
| 10,210,779 | B2 | 2/2019 | Enriquez |
| 10,223,939 | B2 | 3/2019 | Warmus |
| 10,269,268 | B2 * | 4/2019 | Debarros ..... G09F 1/065 |
| 10,685,588 | B2 | 6/2020 | Lyon |
| 10,706,747 | B2 | 7/2020 | Santoro |
| 10,741,109 | B2 | 8/2020 | Enriquez |
| 2004/0111930 | A1 | 6/2004 | Ossmann |
| 2006/0260165 | A1 | 11/2006 | Chenel |
| 2008/0066353 | A1 | 3/2008 | Mills |
| 2008/0083146 | A1 | 4/2008 | Martin Presa |
| 2010/0072330 | A1 | 3/2010 | Tzuo |
| 2010/0236117 | A1 | 9/2010 | Mestres Armengol et al. |
| 2011/0088300 | A1 | 4/2011 | Martin Presa |
| 2012/0012734 | A1 | 1/2012 | Tzuo |
| 2012/0227297 | A1 | 9/2012 | Kawaguchi et al. |
| 2013/0219760 | A1 | 8/2013 | Acker et al. |
| 2014/0205772 | A1 | 7/2014 | Sitton |
| 2014/0265777 | A1 | 9/2014 | Fischer et al. |
| 2016/0335925 | A1 | 11/2016 | Ruhaak |
| 2016/0335934 | A1 | 11/2016 | Lyon |
| 2016/0335935 | A1 | 11/2016 | Lyon |
| 2017/0193866 | A1 | 7/2017 | Bonifas |
| 2017/0213485 | A1 | 7/2017 | Santoro, Jr. |
| 2017/0249874 | A1 | 8/2017 | Lopez Fernandez |
| 2017/0294149 | A1 | 10/2017 | Lyon |
| 2018/0040262 | A1 | 2/2018 | Lyon |
| 2018/0075781 | A1 | 3/2018 | Cwidak et al. |
| 2018/0075788 | A1 | 3/2018 | Warmus et al. |
| 2018/0211571 | A1 | 7/2018 | Enriquez |
| 2019/0066550 | A1 | 2/2019 | Enriquez |
| 2019/0279534 | A1 | 9/2019 | Lyon |

FOREIGN PATENT DOCUMENTS

| | | |
|---|---|---|
| CN | 102005160 | 4/2011 |
| CN | 202711641 | 1/2013 |
| CN | 203192354 | 9/2013 |
| CN | 103989359 | 8/2014 |
| CN | 204257165 | 4/2015 |
| CN | 205722637 | 11/2016 |
| CN | 205789003 | 12/2016 |
| CN | 101061527 | 10/2017 |
| DE | 2658506 | 1/1978 |
| DE | 4005925 | 10/1991 |
| DE | 4314654 | 11/1994 |
| DE | 9320993 | 8/1995 |
| DE | 202010015312 | 1/2011 |
| DE | 202011002980 | 4/2011 |
| DE | 202014106297 | 3/2015 |
| DK | 9500055 | 5/1995 |
| DK | 9500277 | 9/1995 |
| EP | 1741368 | 1/2007 |
| EP | 1830334 | 9/2007 |
| EP | 1926076 | 5/2008 |
| EP | 2290637 | 3/2011 |
| EP | 2400477 | 12/2011 |
| ES | 2212927 | 8/2004 |
| ES | 2255857 | 7/2006 |
| FR | 1254983 | 3/1961 |
| FR | 2210317 | 6/1974 |
| FR | 2232259 | 12/1974 |
| FR | 2233912 | 1/1975 |
| FR | 2571949 | 4/1986 |
| FR | 2574968 | 6/1986 |

(56) References Cited

FOREIGN PATENT DOCUMENTS

| | | |
|---|---|---|
| FR | 2650907 | 2/1991 |
| FR | 2680030 | 2/1993 |
| FR | 2691621 | 12/1993 |
| FR | 2730148 | 8/1996 |
| FR | 2735264 | 12/1996 |
| FR | 2745109 | 8/1997 |
| FR | 2760801 | 9/1998 |
| FR | 2760802 | 9/1998 |
| FR | 2760880 | 9/1998 |
| FR | 2770320 | 4/1999 |
| FR | 2897970 | 8/2007 |
| FR | 2911425 | 7/2008 |
| FR | 2925203 | 6/2009 |
| FR | 2925204 | 6/2009 |
| FR | 2929035 | 9/2009 |
| FR | 2948222 | 1/2011 |
| GB | 463574 | 4/1937 |
| GB | 740577 | 11/1955 |
| GB | 743378 | 1/1956 |
| GB | 824004 | 11/1959 |
| GB | 1034280 | 6/1966 |
| GB | 1272187 | 4/1972 |
| GB | 1317155 | 5/1973 |
| JP | 2003530602 | 10/2003 |
| WO | 9634379 | 10/1996 |
| WO | 99/36900 | 7/1999 |
| WO | 02095719 | 11/2002 |
| WO | 2004044867 | 5/2004 |
| WO | 2006040438 | 4/2006 |
| WO | 2006067252 | 6/2006 |
| WO | 2007138083 | 12/2007 |
| WO | 2008049176 | 5/2008 |
| WO | 2008125703 | 10/2008 |
| WO | 2010019086 | 2/2010 |
| WO | 2010130485 | 11/2010 |
| WO | 2011092209 | 8/2011 |
| WO | 2011113123 | 9/2011 |
| WO | 2012061375 | 5/2012 |
| WO | 2012164114 | 12/2012 |
| WO | 2016057067 | 4/2016 |
| WO | 2016071868 | 5/2016 |
| WO | 2017116605 | 7/2017 |
| WO | 2018027118 | 2/2018 |

OTHER PUBLICATIONS

United States Patent and Trademark Office, "Notice of Allowance," issued in connection with U.S. Appl. No. 14/709,266, dated Sep. 26, 2016, 9 pages.
United States Patent and Trademark Office, "Non-Final Office Action," issued in connection with U.S. Appl. No. 14/709,285, dated Sep. 15, 2016, 9 pages.
United States Patent and Trademark Office, "Non-Final Office Action," issued in connection with U.S. Appl. No. 14/711,739, dated Sep. 16, 2016, 7 pages.
United States Patent and Trademark Office, "Non-Final Office Action," issued in connection with U.S. Appl. No. 15/229,920, dated Dec. 1, 2016, 7 pages.
United States Patent and Trademark Office, "Non-Final Office Action," dated Sep. 19, 2019 in connection with U.S. Appl. No. 15/415,594, 7 pages.
United States Patent and Trademark Office, "Office Action," issued in connection with U.S. Appl. No. 14/709,285, dated Mar. 15, 2017, 7 pages.
United States Patent and Trademark Office, "Notice of Allowance," issued in connection with U.S. Appl. No. 15/229,920, dated Mar. 22, 2017, 7 pages.
United States Patent and Trademark Office, "Final Office Action," issued in connection with U.S. Appl. No. 14/711,739, dated Mar. 21, 2017, 6 pages.
United States Patent and Trademark Office, "Non-final Office Action," issued in connection with U.S. Appl. No. 14/988,616, dated Apr. 11, 2017, 8 pages.
United States Patent and Trademark Office, "Notice of Allowance," issued in connection with U.S. Appl. No. 14/709,266, dated Apr. 12, 2017, 5 pages.
United States Patent and Trademark Office, "Notice of Allowance," issued in connection with U.S. Appl. No. 14/709,285, dated Jul. 3, 2017, 8 pages.
United States Patent and Trademark Office, "Non-Final Office Action," issued in connection with U.S. Appl. No. 15/415,587, dated Aug. 4, 2017, 9 pages.
United States Patent and Trademark Office, "Non-Final Office Action," issued in connection with U.S. Appl. No. 15/261,178, dated Sep. 29, 2017, 11 pages.
United States Patent and Trademark Office, "Final Office Action," issued in connection with U.S. Appl. No. 15/634,974, dated Oct. 25, 2018, 8 pages.
United States Patent and Trademark Office, "Advisory Action," dated Jun. 11, 2019 in connection with U.S. Appl. No. 15/690,031, 3 pages.
United States Patent and Trademark Office, "Notice of Allowance," issued in connection with U.S. Appl. No. 15/415,587, dated Jan. 19, 2018, 7 pages.
United States Patent and Trademark Office, "Notice of Allowance," issued in connection with U.S. Appl. No. 14/988,616, dated Feb. 28, 2018, 8 pages.
United States Patent and Trademark Office, "Non-Final Office Action," issued in connection with U.S. Appl. No. 15/634,974, dated Apr. 9, 2018, 7 pages.
United States Patent and Trademark Office, "Notice of Allowance," issued in connection with U.S. Appl. No. 15/261,178, dated Aug. 3, 2018, 5 pages.
United States Patent and Trademark Office, "Restriction Requirement," dated Aug. 31, 2018 in connection with U.S. Appl. No. 15/261,191, 5 pages.
United States Patent and Trademark Office, "Non-Final Office Action," dated Oct. 2, 2018, in connection with U.S. Appl. No. 15/786,405, 8 pages.
United States Patent and Trademark Office, "Notice of Allowance," issued in connection with U.S. Appl. No. 15/786,405, dated Feb. 1, 2019, 9 pages.
State Intellectual Property Office of the People's Republic of China, "Notice of Allowance," dated Mar. 16, 2018 in connection with Chinese Patent Application No. 201720947684.5, 4 pages (full document and English translation).
United States Patent and Trademark Office, "Notice of Allowance," dated Oct. 17, 2019 in connection with U.S. Appl. No. 15/261,191, 6 pages.
United States Patent and Trademark Office, "Non-Final Office Action," dated Oct. 11, 2019 in connection with U.S. Appl. No. 15/690,031, 7 pages.
United States Patent and Trademark Office, "Final Office Action," issued in connection with U.S. Appl. No. 15/261,178, dated Apr. 11, 2018, 12 pages.
United States Patent and Trademark Office, "Final Office Action," issued in connection with U.S. Appl. No. 14/988,616, dated Oct. 30, 2017, 9 pages.
United States Patent and Trademark Office, "Non-Final Office Action," issued in connection with U.S. Appl. No. 15/261,191, dated Jan. 23, 2019, 10 pages.
United States Patent and Trademark Office, "Notice of Allowance," dated Jul. 1, 2019 in connection with U.S. Appl. No. 15/261,191, 8 pages.
United States Patent and Trademark Office, "Non-Final Office Action," issued in connection with U.S. Appl. No. 16/201,535, dated Jan. 25, 2019, 13 pages.
United States Patent and Trademark Office, "Non-Final Office Action," issued in connection with U.S. Appl. No. 16/201,535, dated Aug. 8, 2019, 11 pages.
State Intellectual Property Office of the People's Republic of China, "First Office Action," dated May 24, 2019 in connection with Chinese Patent Application No. 201710340752.6, 25 pages.
United States Patent and Trademark Office, "Notice of Allowance," dated Sep. 21, 2018 in connection with U.S. Appl. No. 15/909,155, 7 pages.

(56) References Cited

OTHER PUBLICATIONS

United States Patent and Trademark Office, "Non-Final Office Action," dated Jun. 25, 2018 in connection with U.S. Appl. No. 15/690,031, 8 pages.
United States Patent and Trademark Office, "Final Office Action," dated Feb. 25, 2019 in connection with U.S. Appl. No. 15/690,031, 9 pages.
United States Patent and Trademark Office, "Non-Final Office Action," dated Apr. 5, 2018 in connection with U.S. Appl. No. 15/657,548, 8 pages.
United States Patent and Trademark Office, "Notice of Allowance," dated Oct. 23, 2018 in connection with U.S. Appl. No. 15/657,548, 8 pages.
United States Patent and Trademark Office, "Notice of Allowance," issued in connection with U.S. Appl. No. 14/711,739, dated Jun. 8, 2017, 9 pages.
China National Intellectual Property Administration (CNIPA), "First Office Action," dated Oct. 24, 2019, in connection with Chinese Patent Application No. 201810209272.0, 13 pages (Full document and English translation).
China National Intellectual Property Administration (CNIPA), "Notice of Allowance," dated Nov. 12, 2019 in connection with Chinese Patent Application No. 201710340752.6, 7 pages (full document and English translation).
United States Patent and Trademark Office, "Corrected Notice of Allowance," dated Dec. 26, 2019 in connection with U.S. Appl. No. 15/261,191, 3 pages.
United States Patent and Trademark Office, "Notice of Allowance," dated Feb. 6, 2020 in connection with U.S. Appl. No. 16/421,116, 7 pages.
United States Patent and Trademark Office, "Notice of Allowance," dated Feb. 27, 2020 in connection with U.S. Appl. No. 16/201,535, 8 pages.
China National Intellectual Property Administration (CNIPA), "First Office Action," dated Aug. 18, 2020, in connection with Chinese Patent Application No. 201780061926.3, 12 pages.
United States Patent and Trademark Office, "Notice of Allowance," dated Mar. 30, 2020 in connection with U.S. Appl. No. 15/690,031, 6 pages.
China National Intellectual Property Administration (CNIPA), "Notice of Allowance," dated Mar. 27, 2020, in connection with Chinese Patent Application No. 201810209272.0, 6 pages (Full document and English translation).
United States Patent and Trademark Office, "Notice of Allowance," dated Apr. 8, 2020 in connection with U.S. Appl. No. 15/415,594, 8 pages.
United States Patent and Trademark Office, "Notice of Allowability," dated Apr. 1, 2020 In connection with U.S. Appl. No. 16/201,535, 3 pages.
United States Patent and Trademark Office, "Corrected Notice of Allowability," dated May 15, 2020 in connection with U.S. Appl. No. 16/421,116, 2 pages.
China National Intellectual Property Administration (CNIPA), "First Office Action," dated Mar. 2, 2021, in connection with Chinese Patent Application No. 201810071871.0, 28 pages (including translation).
International Seraching Authority, "International Search Report and Written Opinion," issued in connection with the International Application No. PCT/US2016/064478, dated Jan. 24, 2017, 15 pages.
International Searching Authority, "Search Report," issued in connection with PCT patent application No. PCT/US2017/045471, dated Oct. 18, 2017, 5 pages.
International Searching Authority, "Written Opinion," issued in connection with PCT patent application No. PCT/US2017/045471, dated Oct. 18, 2017, 6 pages.
China National Intellectual Property Administration, "Notification of Grant of Patent for Invention," mailed in connection with Chinese Patent Application No. 201780061926.3, dated Apr. 22, 2021, 8 pages.

* cited by examiner

POP-UP DISPLAY AND POP-UP DISPLAY LOCKING MECHANISM THEREFORE

RELATED APPLICATIONS

This patent arises from the U.S. national stage of International Patent Application Serial No. PCT/US2017/045471, having an international filing date of Aug. 4, 2017, and claims benefit of U.S. Provisional Patent Application No. 62/371,537, filed on Aug. 5, 2016. Priority is claimed to International Patent Application Serial No. PCT/US17/45471 and U.S. Provisional Patent Application No. 62/371,537. Both International Patent Application Serial No. PCT/US17/45471 and U.S. Provisional Patent Application No. 62/371,537, are hereby incorporated by reference in their entireties for all purposes.

FIELD OF THE DISCLOSURE

This disclosure relates generally to displays and, more particularly, to erectable displays and methods of making such erectable displays.

BACKGROUND

Displays may be used at a point of purchase to provide advertising or other information. Some of these displays have a tubular shape and include outwardly facing indicia.

BRIEF DESCRIPTION OF THE DRAWINGS

The figures are not to scale. Wherever possible, the same reference numbers will be used throughout the drawings and accompanying written description to refer to the same or like parts.

DETAILED DESCRIPTION

The examples disclosed herein relate to erectable displays that can be used for point-of-sale advertising, providing information or for other suitable purposes. The example erectable displays disclosed herein are configured to be collapsed to a folded, flat state, which facilitates shipping and transport, and readily erected at a location (e.g., a point-of-sale, a conference booth, a store, etc.) to effect a desired display function.

In some examples disclosed herein, the example erectable displays include one or more substrates (e.g., a sheet material, a panel, etc.) that, singly or in combination, form a tubular shroud into which one or more internal support structures are disposed or are able to be disposed. In some examples, the shroud defines a generally oblong cross-section having, along a longitudinal direction thereof (e.g., a height), a major axis dimension (e.g., a width) and a minor axis dimension (e.g., a depth). A base structure is optionally attached to or integrated with one or more portions of the shroud, such as a base portion, to help to maintain the shroud in a desired orientation. While one particular example of an oblong cross-section is depicted herein, the present concepts include other manners of cross-sectional profile including, but not limited to, a triangular, square, diamond, circular, or other semi-circular, elliptical, polygonal shape and/or non-polygonal shapes.

In some examples, the example shroud is formed of an elongate substrate having top and bottom edges and first and second side edges. To enable the example erectable display to be folded for transport or shipping and/or storage, in some examples, longitudinal lines of weakness and/or transverse lines of weakness are defined by the shroud. These lines of weakness enable the example erectable display to be folded relatively flat, with adjacent segments of the shroud being folding against one-another along the lines of weakness, such as in a multi-part z-fold, for example.

In some examples, as noted above, the shroud is formed from separate substrates that are coupled together to form a 3-D structure defining an interior volume. In some examples, the example support is formed of two substrates and one or more support portions disposed therein. In some examples, the support portions are generally planar. In yet further examples, the support portions are generally planar and are further advantageously provided with a line of weakness to enable the support portion to be folded relatively flat within the example shroud for transport, shipping and/or storage.

As is described herein, the erectable display is formed by (1) assembling one or more substrates together with one or more support portions or (2) by unfurling a completed erectable display from a folded state.

Figure 1:
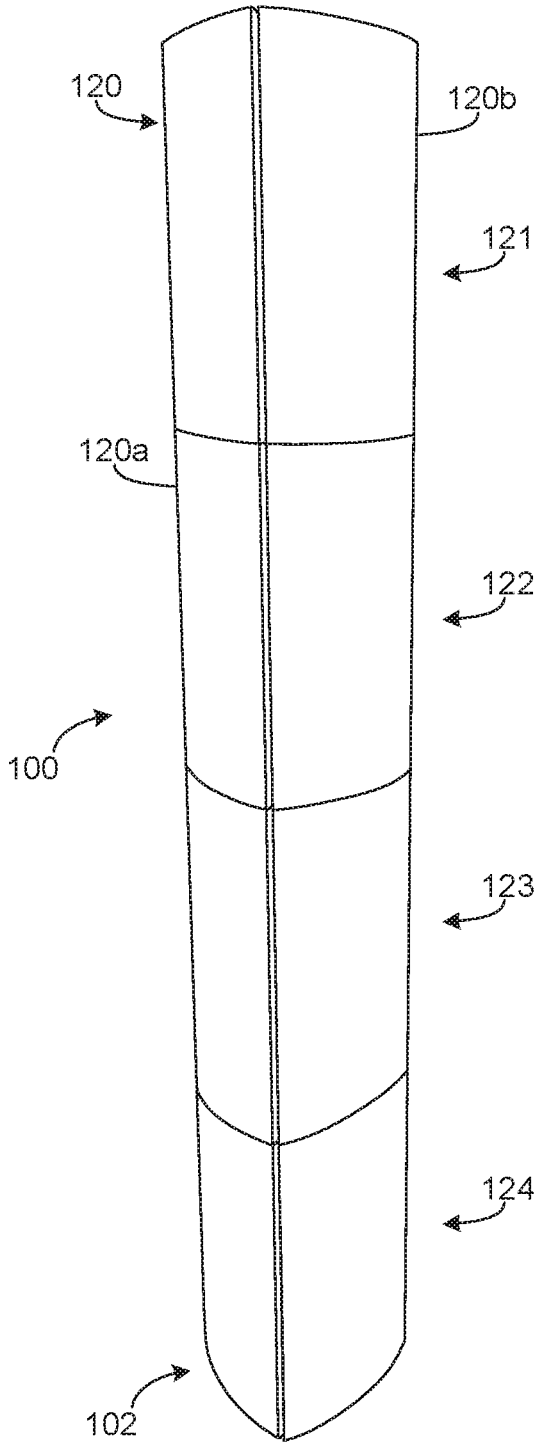
FIG. 1 is a perspective view of an example an erectable display, showing a shroud, in an erected state in accord with at least some concepts disclosed herein.

FIG. 1 illustrates an example of an erectable display 100 including a tubular-shaped shroud 120 formed from two sheets 120*a*, 120*b* and defining an interior volume therebetween. In the example shown, the erectable display 100 is supported by a base portion 102 of the shroud 120. In another aspect of the present concepts, the tubular-shaped shroud 120 is formed from a single sheet having two parts (e.g., 120*a*, 120*b*) connected by a central line of weakness, or joint. The two halves of the sheet are folded about the line of weakness so that the distal edges of the sheet abut one another and are connectable to form a joint to thereby define the tubular-shaped shroud. The shroud 120 is optionally coupled to a separate base (not shown).

As shown in the example of FIG. 1, the shroud 120 includes four segments 121-124, each segment being connected to an adjacent segment by a line of weakness, or joint, to facilitate deployment and/or stowage. In other aspects, the shroud 120 may comprise n segments, where n is any number including, but not limited to, one segment, 2 segments, 3 segments, 4 segments (as shown), or more than 4 segments.

Figure 2:
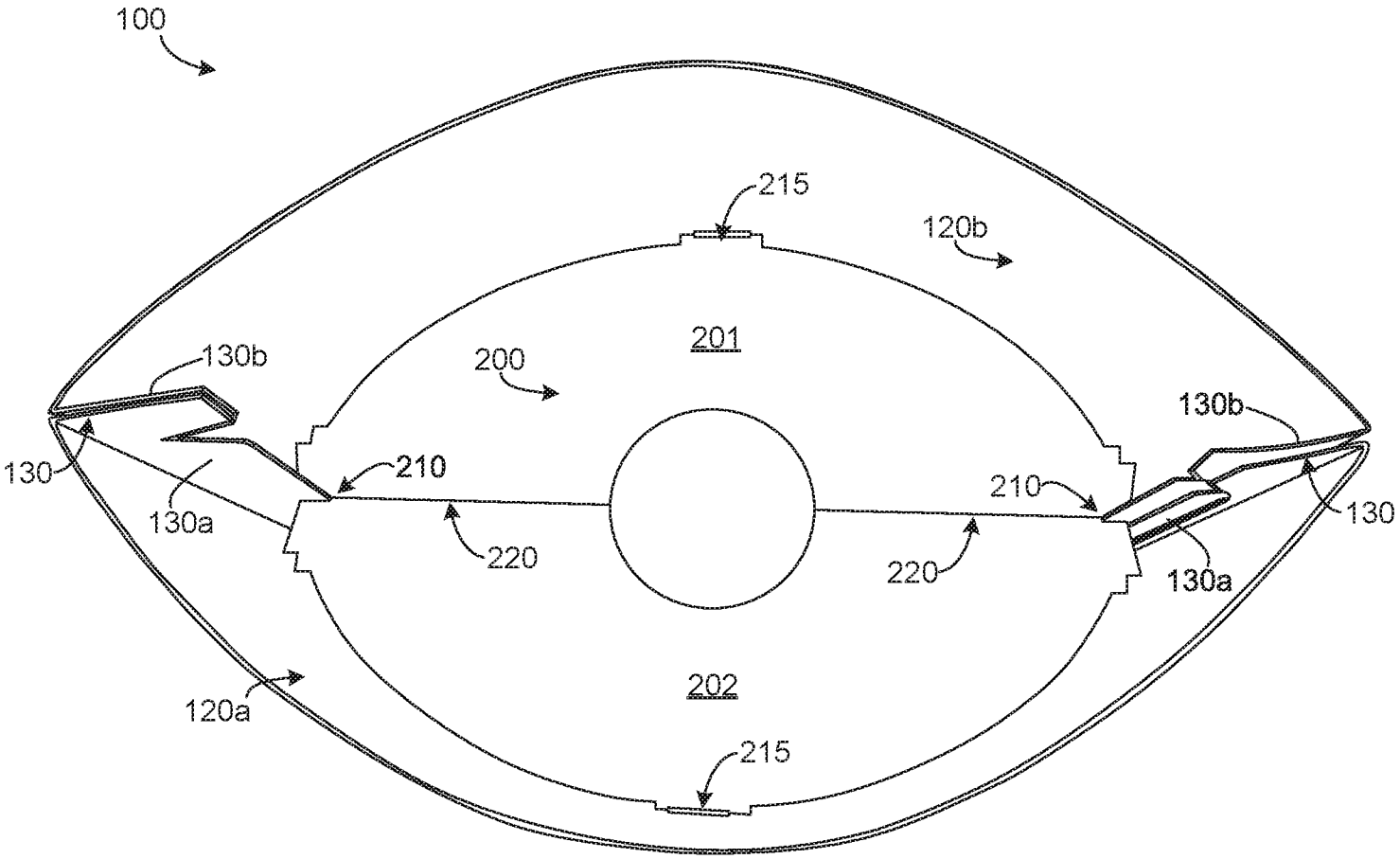
FIG. 2 is a top view of the erected display of FIG. 1, showing an interior volume defined by the shroud and showing an example of a support member or former in accord with at least some aspects of the concepts disclosed herein.

FIG. 2 shows a top down view of an example of a shroud 120 support member or former 200 disposed between the opposing first sheet 120*a* and second sheet 120*b* to extend between the first joint 130 formed by flaps 130*a*, 130*b* (left side of FIG. 2) and the second joint 130 formed by flaps 130*a*, 130*b* (right side of FIG. 2). The example support member or former 200 shown in FIG. 2 is curvilinear in profile and, in presently preferred aspects, is an ovoid, elliptical or oblong shape having a major axis extending between the first joint and the second joint of the shroud 120. In other aspects, the support member or former 200 (hereinafter "support member") could comprise a different curvilinear shape, such as a circular shape, a polygonal shape, or a polygon approximating a curvilinear shape (e.g., a heptagon, nonagon, or hendecagon, approximating a circular shape, etc.).

The support member 200 is disposed between the first sheet 120*a* and the second sheet 120*b*, and between the first joint 130 and the second joint 130, to outwardly bias the first sheet 120*a* and the second sheet 120*b* and, more particularly, central portions thereof, to cause the shroud 120 to assume a curvilinear cross-sectional shape along at least a portion of a longitudinal axis of the shroud and, more preferably, along an entire longitudinal axis of the shroud. In the illustrated example, the support member 200 has an ovoid shape and has a line of weakness 220, or joint, extending along a major axis from the first joint 130 to the second joint 130 and defining a first half 201 and a second half 202 of the support member 200.

In the example shown in FIG. 2, the first sheet 120*a* defines flaps 130*a* at side or lateral portions thereof and, similarly, the second sheet 120*b* defines flaps 130*b* at side or lateral portions thereof. In the assembled state represented in FIG. 2, the flaps 130*a*, 130*b* fold inwardly and cooperatively form a joint 130 that serves as a structural element extending into the interior volume defined by the sheets 120*a*, 120*b*.

Figure 7A:
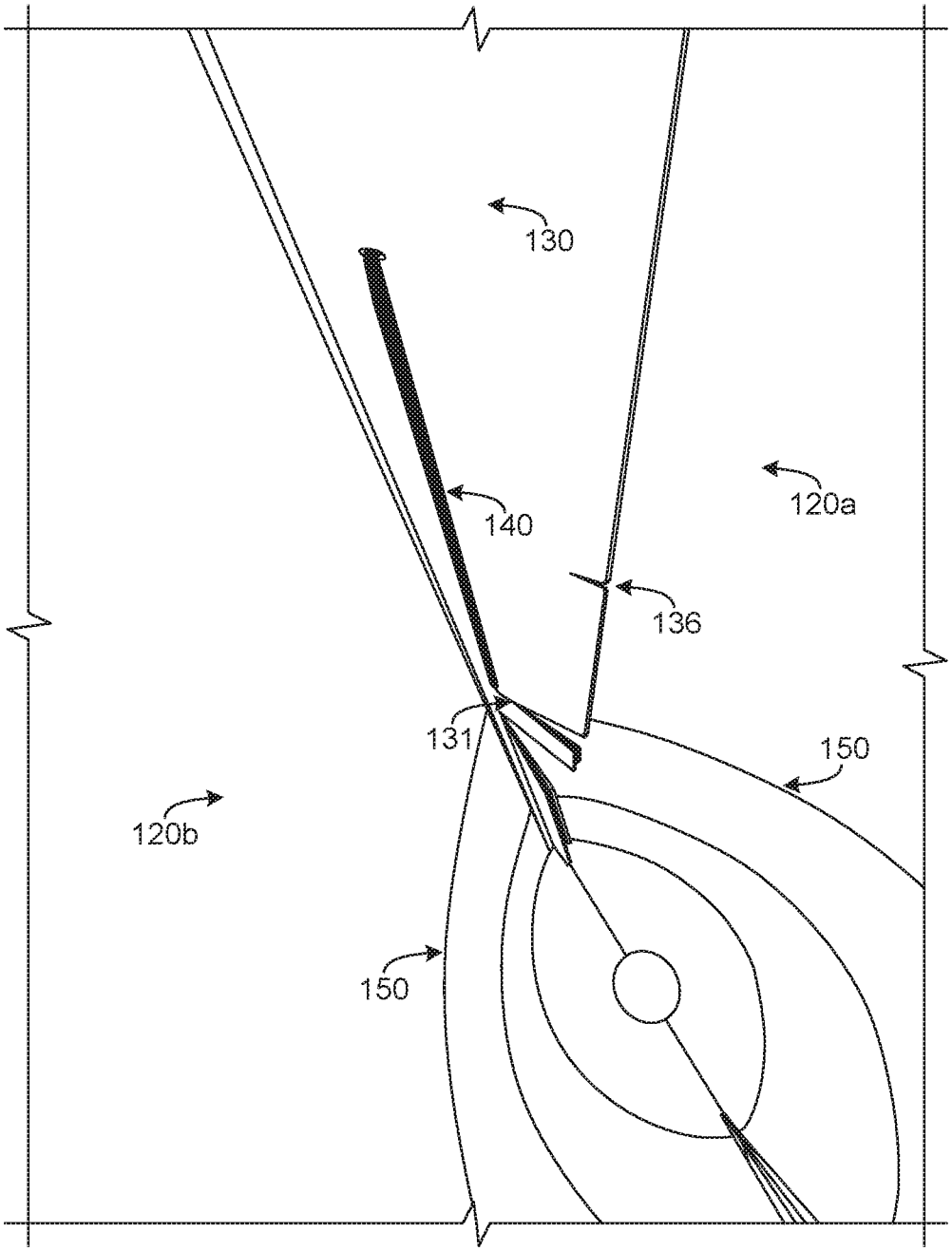
FIGS. 7(*a*)-7(*b*) are top views of an example of an erected erectable display, showing an interior volume defined by the shroud and showing a support member or former and other structural elements in accord with at least some aspects of the concepts disclosed herein.
Figure 7B:
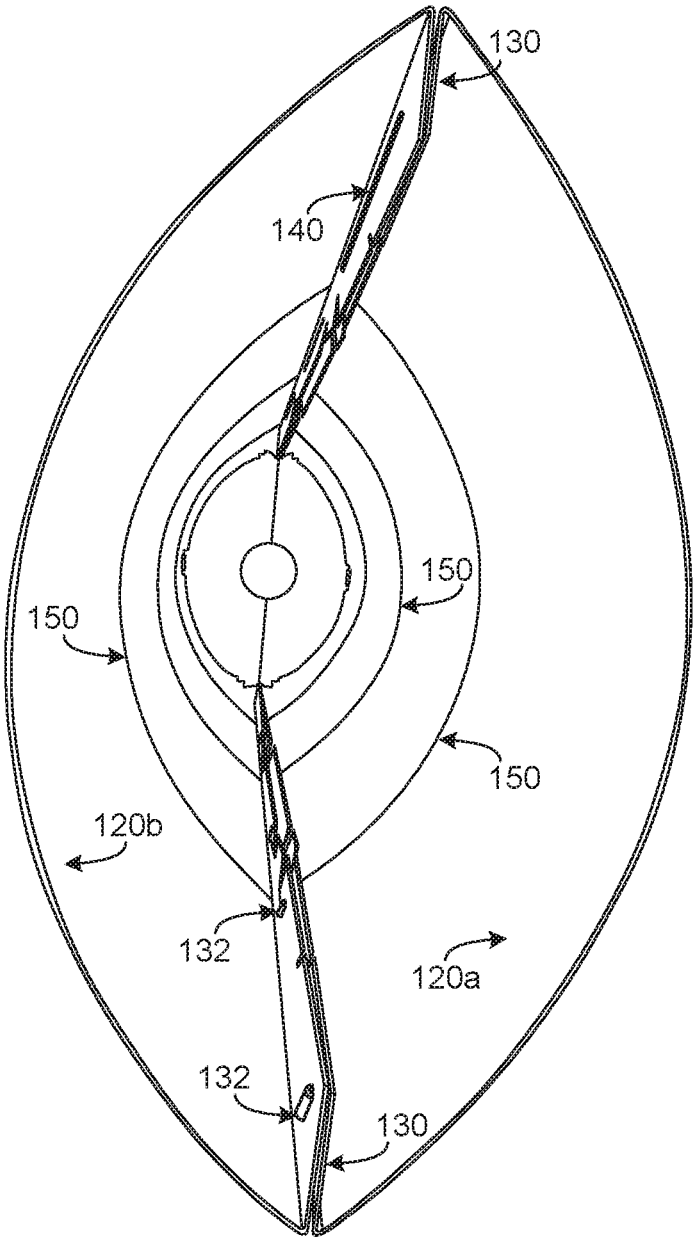
Figure 8A:
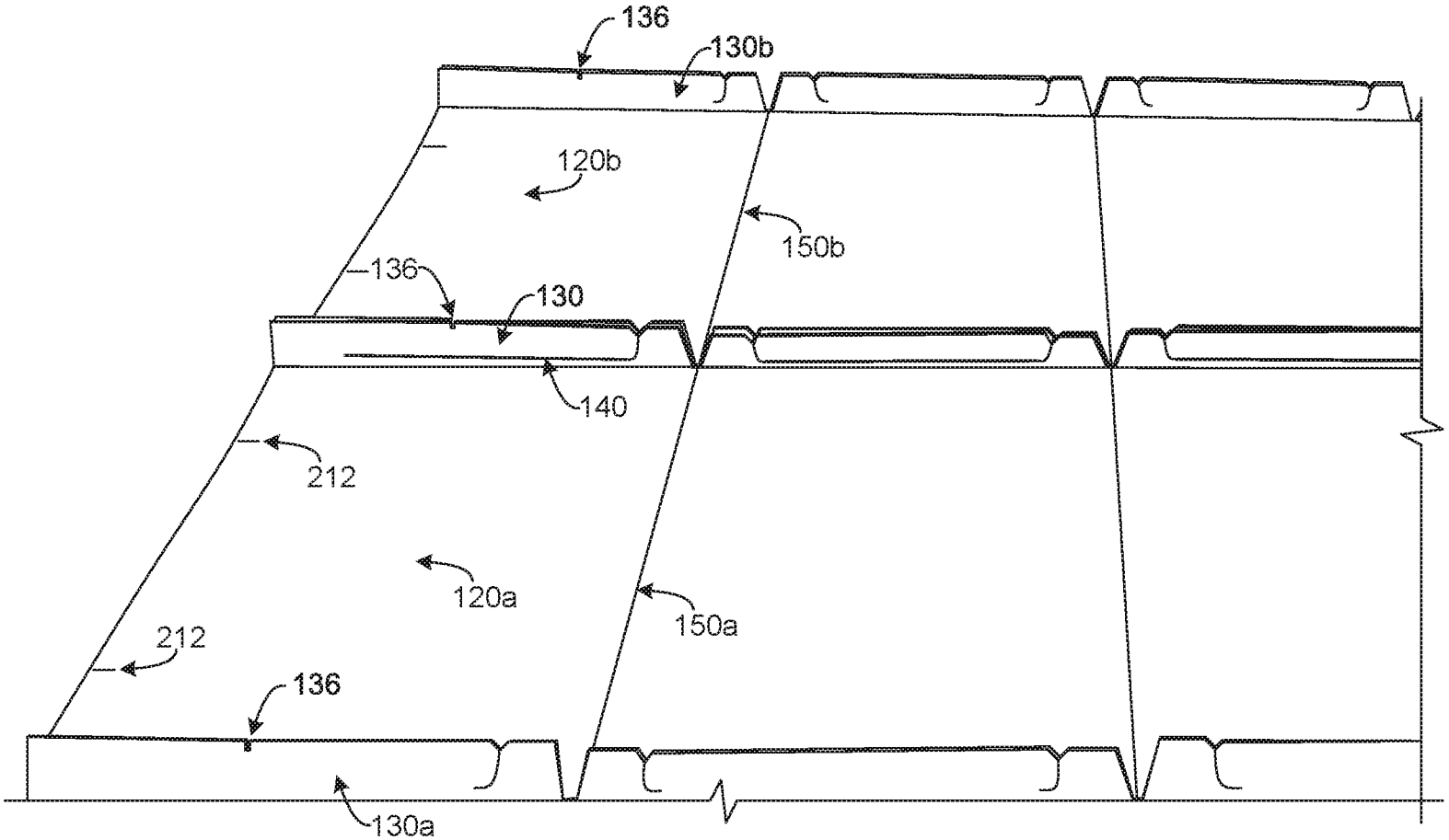
FIGS. 8(*a*)-8(*c*) illustrate an example of construction of an example of an erectable display in accord with at least some aspects of the concepts disclosed herein.
Figure 8B:
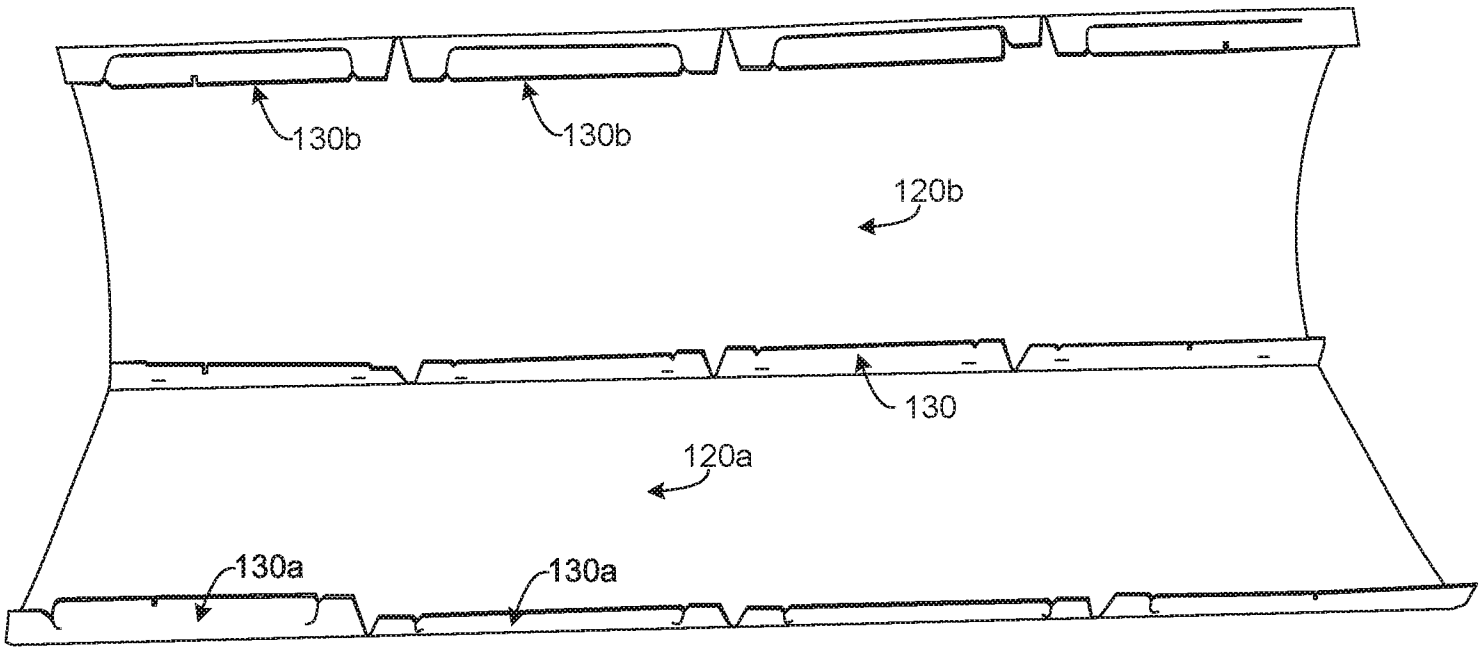
Figure 8C:
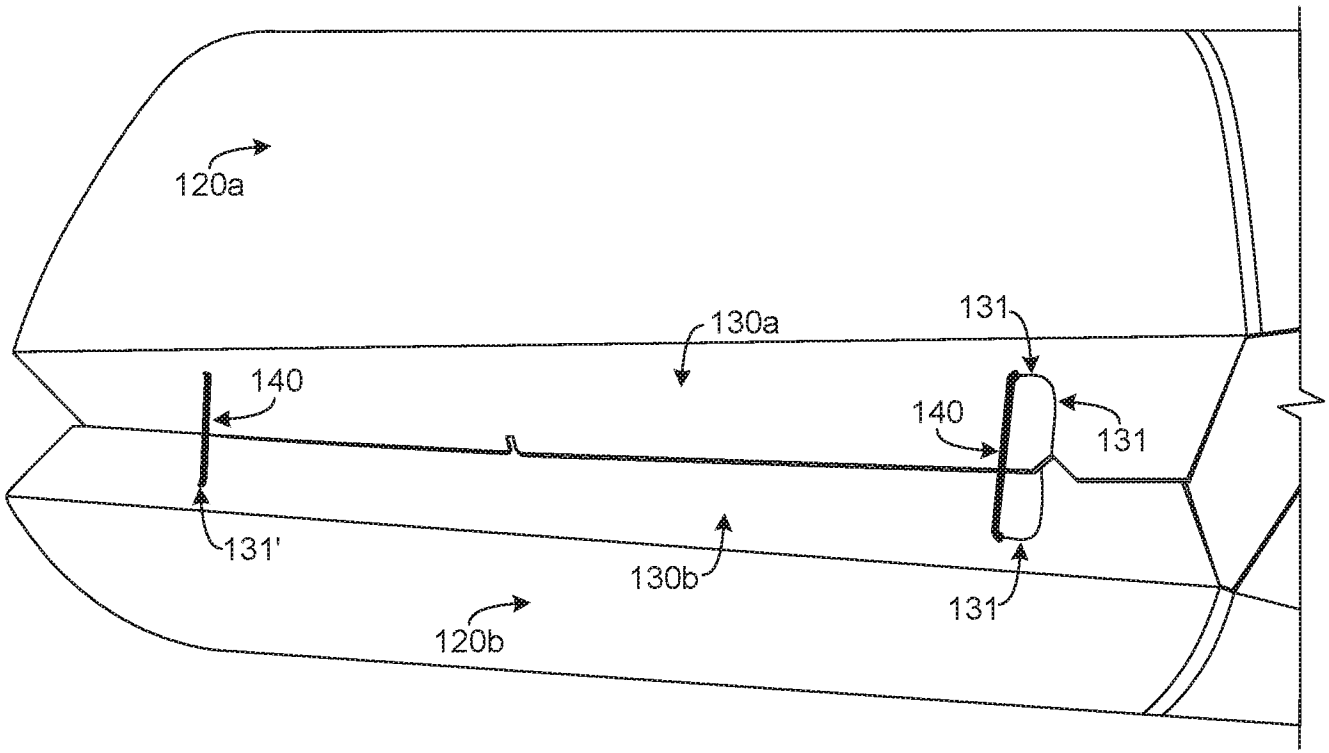

In the example depicted in the accompanying figures, the flaps 130*a*, 130*b* are connected together to form joints 130 connecting sheet 120*a* to sheet 120*b*. This connection between flaps 130*a*, 130*b* comprises, in one example, one or more connection members provided at one or more points along the flaps and, preferably, one or more connection members provided at one or more points per segment (e.g., 121-124). In the illustrated example, the connection members comprise resilient members 140 (see, e.g., FIGS. 3, 4(*f*), 7). In one example, the resilient members 140 comprise a mechanical fastener 132 (e.g., a locking bar, etc.) disposed at each end. In such configuration, as is shown in FIGS. 7-8, the resilient member 140 is pulled taught and stretched between features 131 (e.g., slits, openings, etc.) in the flaps 130*a*, 130*b*, with the locking bar 132 being passed through the features 131 to pull the flaps into engagement with one another upon release of the resilient member. In one aspect, the features 131 comprise eyelets formed in the flaps 130*a*, 130*b* to receive and secure the connection members. In this configuration, the resilient member 140 predominantly contacts a first flap (e.g., 130*a*), with the mechanical fasteners being situated to contact the second flap. In yet another example, the resilient members 140 comprise conventional rubber bands.

Figure 3:
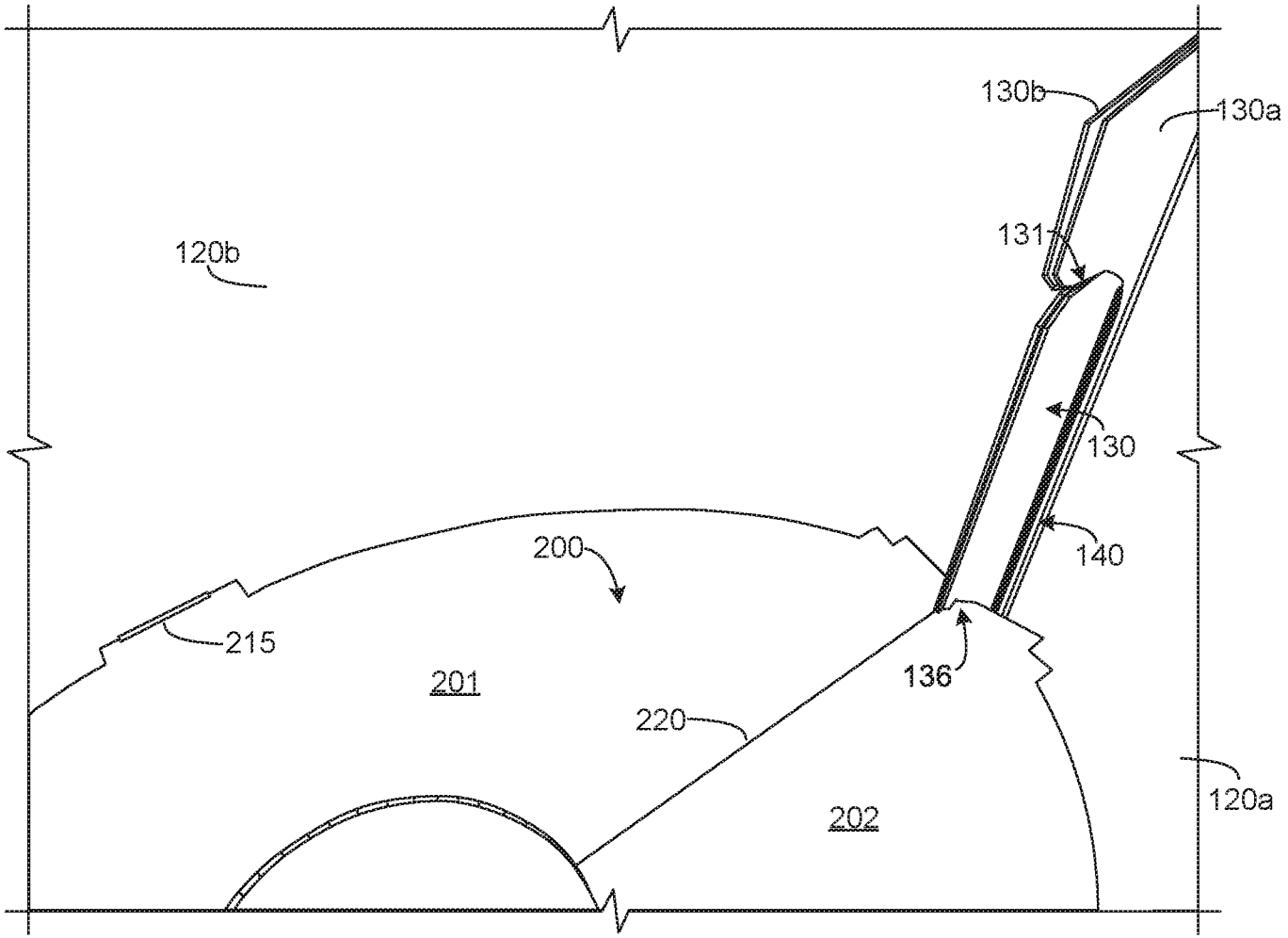
FIG. 3 is a close-up view of the deployed support member or former of FIG. 2 in accord with at least some aspects of the concepts disclosed herein.
Figure 4A:
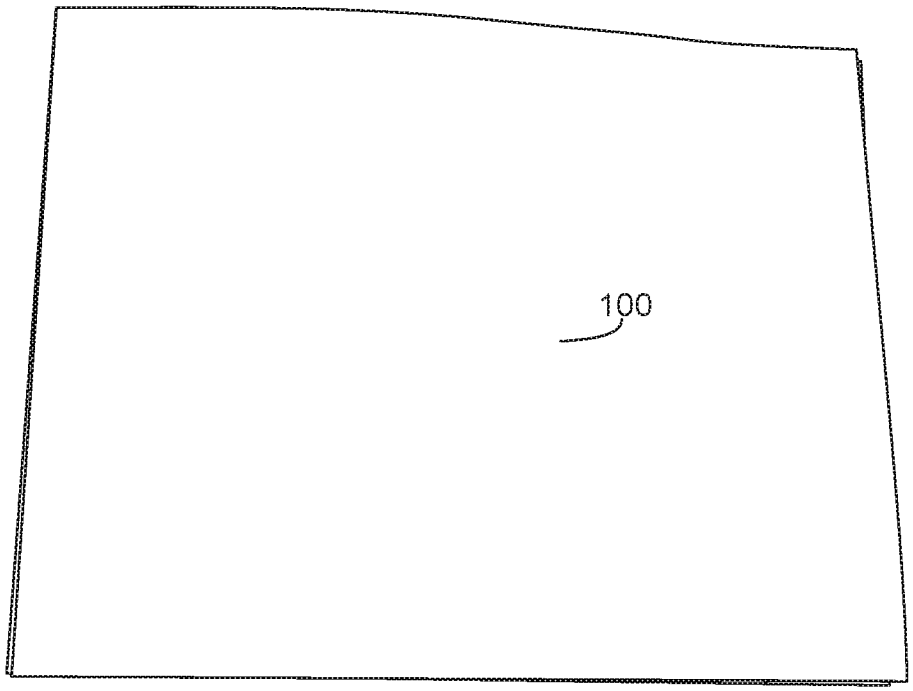
FIGS. 4(*a*)-4(*f*) illustrate different aspects of an example of erecting an erectable display, from a substantially flat initial state to an erected state, in accord with at least some aspects of the concepts disclosed herein.
Figure 4B:
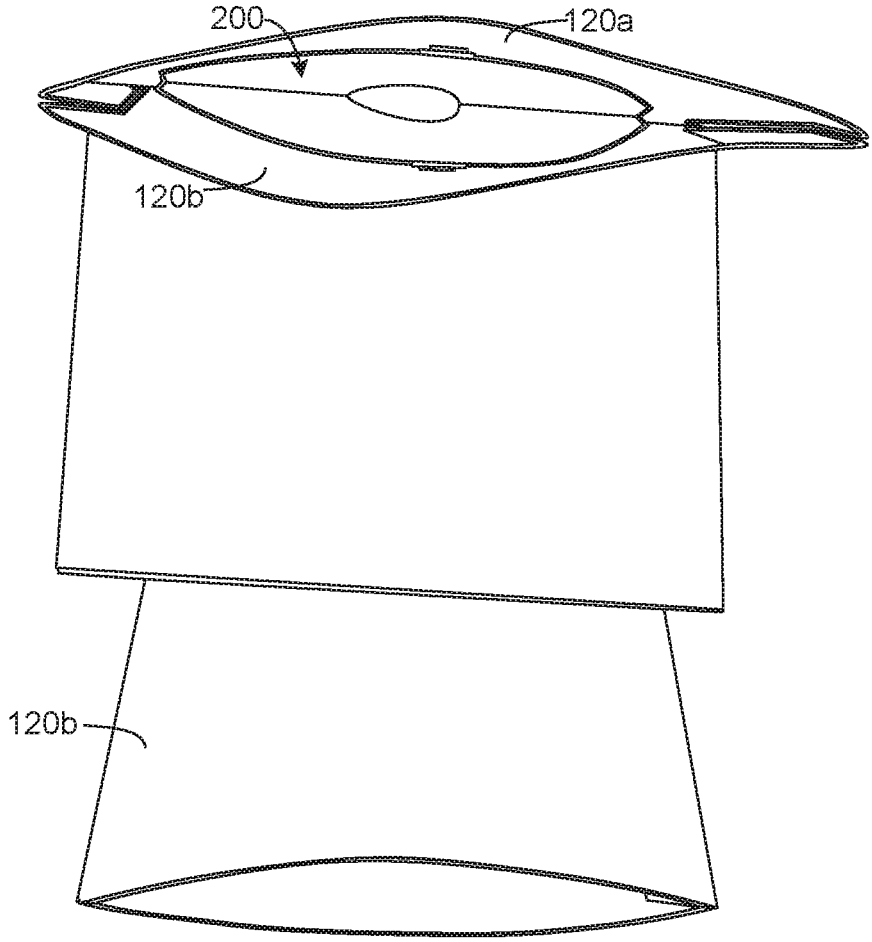
Figure 4C:
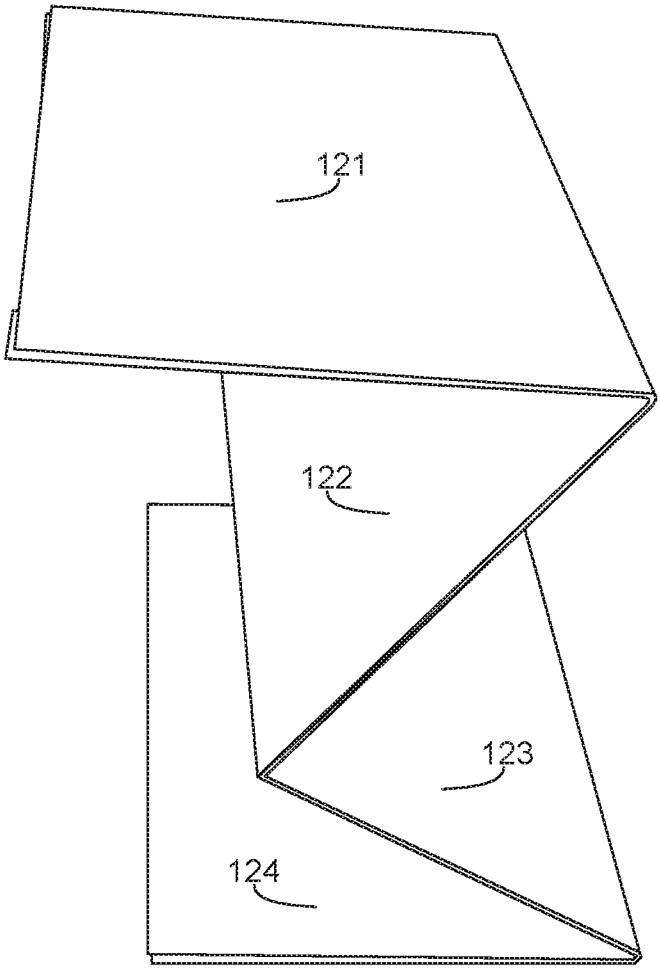
Figure 4D:
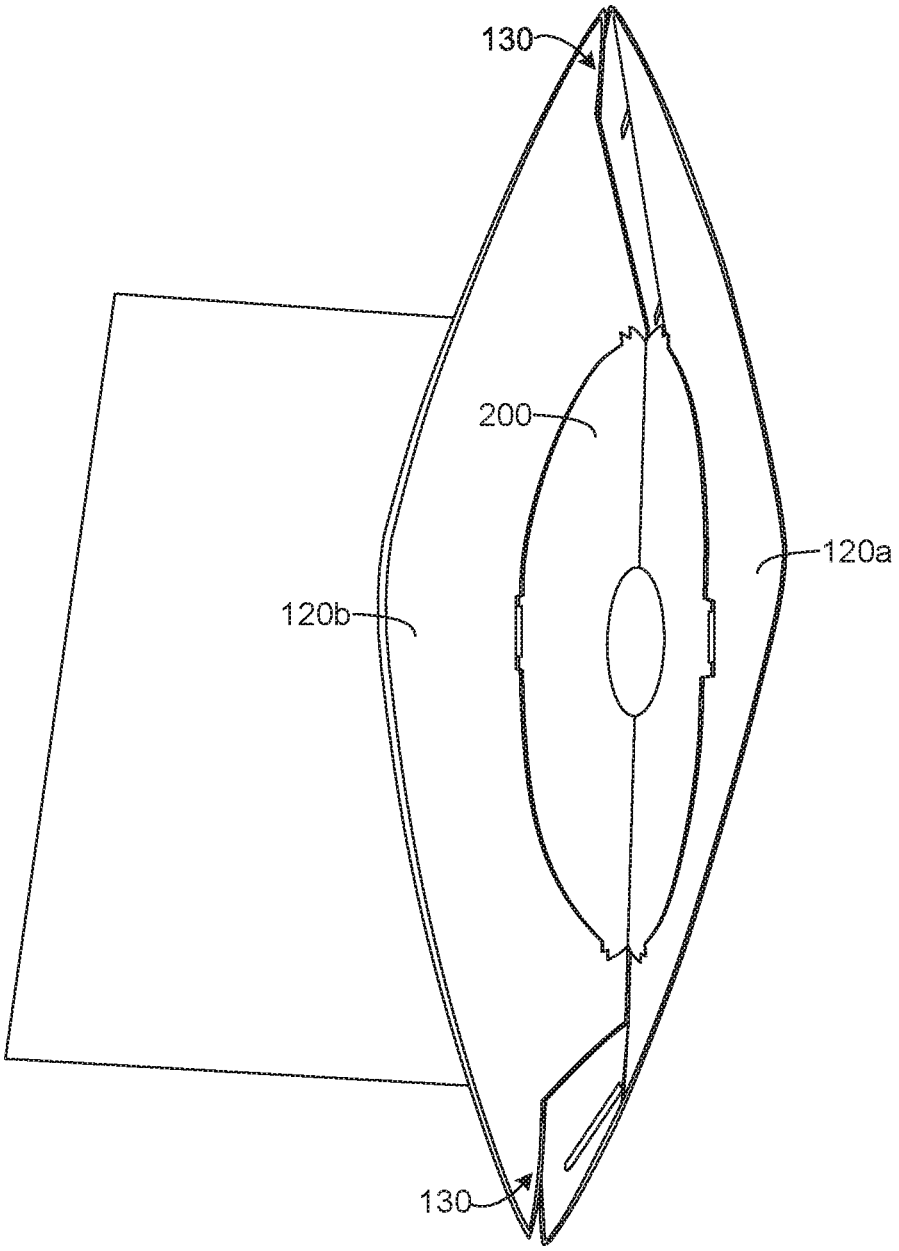
Figure 4E:
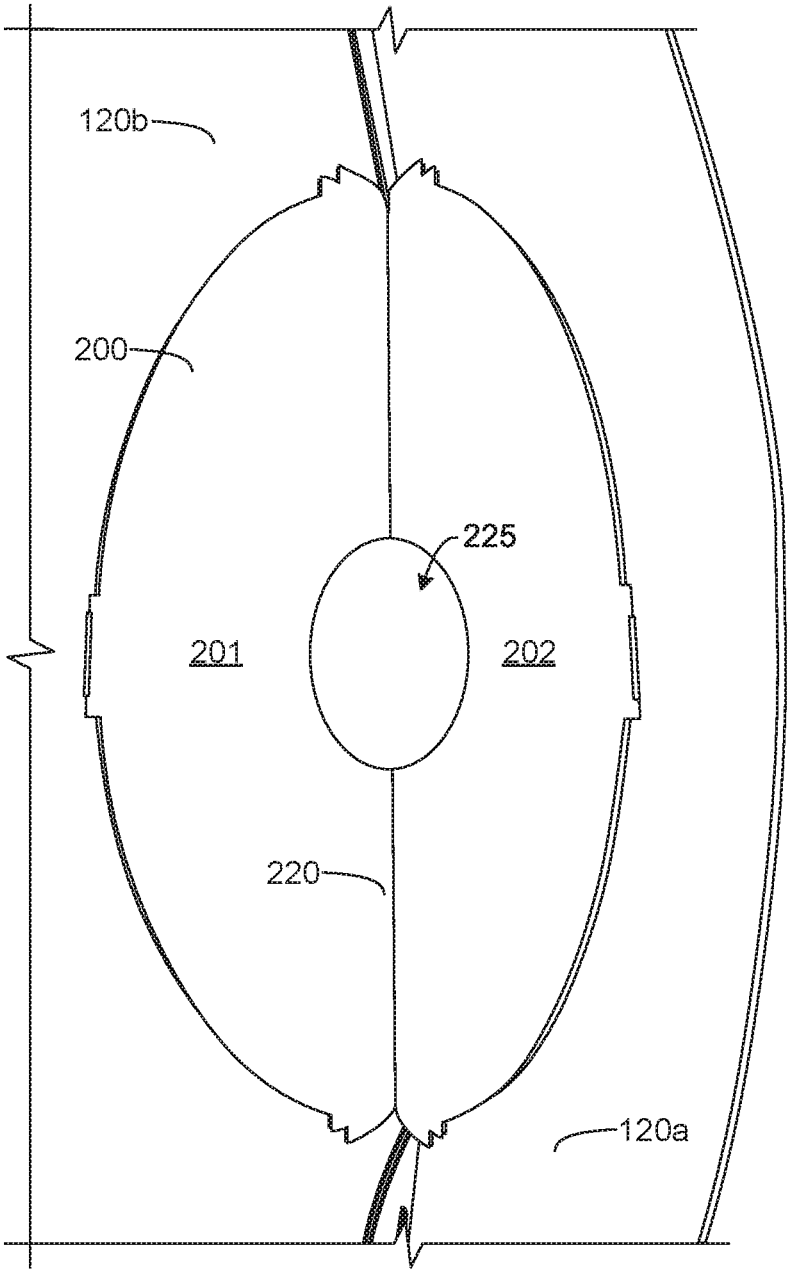
Figure 4F:
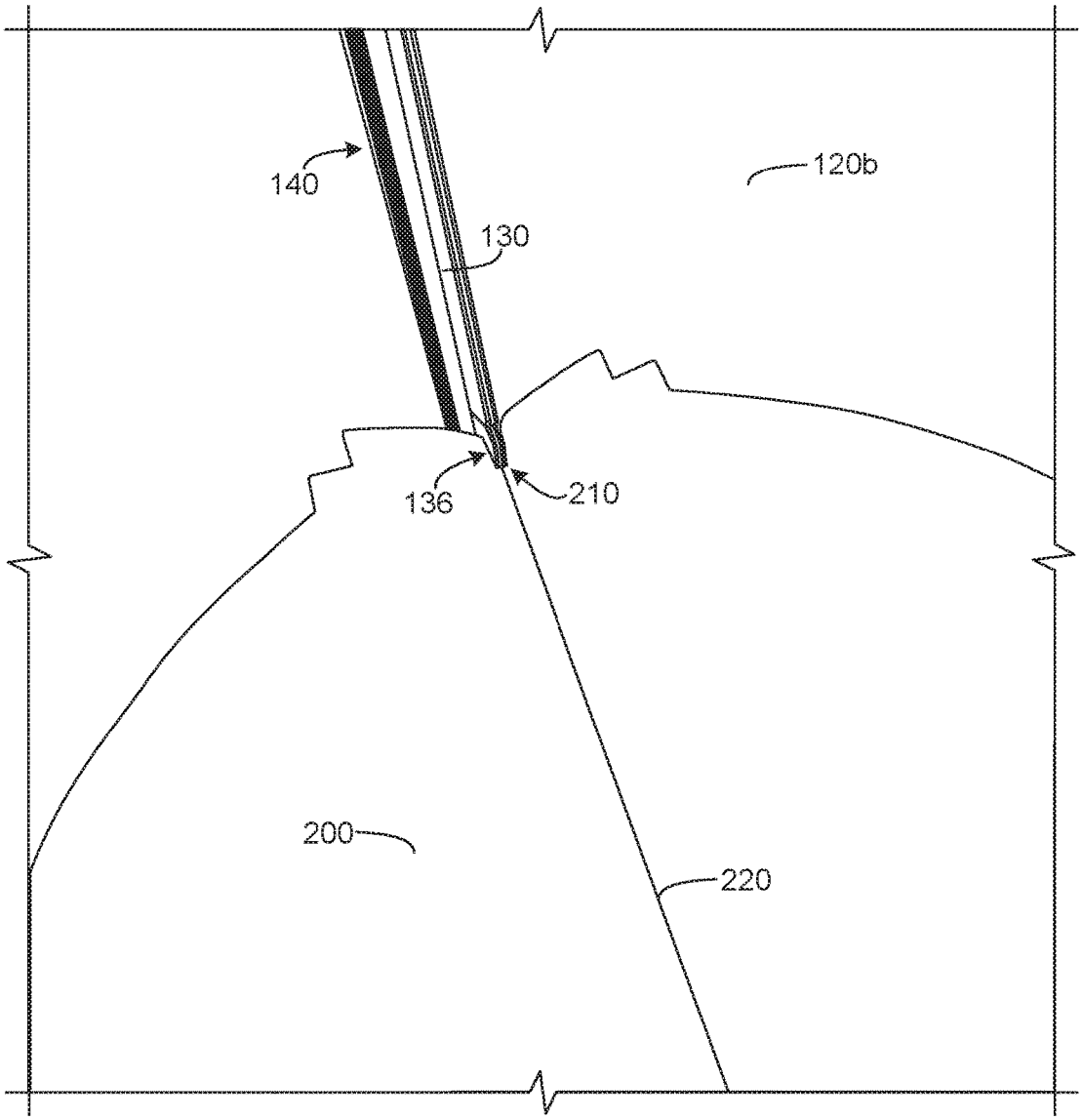

Alternatively, other types of connection members can be used to connect the sheets 120*a*, 120*b* together at the flaps 130*a*, 130*b* at one or more points and, preferably, at one or more points per segment 121-124. Advantageously, the flaps 130*a*, 130*b* are shaped to resist dislodging of a resilient member and comprise features 131, such as is shown in FIG. 3, or other features (e.g., hook shaped features, recesses, etc.) by which connection members may be anchored or tied down. In some examples, the flaps 130*a*, 130*b* are held together by one or more of flap features arranged to interlock or to provide a mechanical friction fit. In still additional examples, the flaps 130*a*, 130*b* comprise clips, hook-and-eye fasteners, hook-and-loop fasteners (e.g., VELCRO® brand fasteners, etc.), pins, snap fasteners, string, twist ties, bonding agents and/or adhesives, in any combination.

Where the shroud 100 uses a single sheet 120 having flaps 130*a*, 130*b* disposed at either lateral end and a line of weakness centrally disposed therebetween to form a first joint 130, the flaps 130*a*, 130*b* are folded onto one another in opposition about the axis of rotation defined by the line of weakness. Once the flaps 130*a*, 130*b* are disposed to abut one another, across the segments (e.g., 121-124), the flaps 130*a*, 130*b* are physically connected to one another to form the second joint of the shroud 100.

Figure 5:
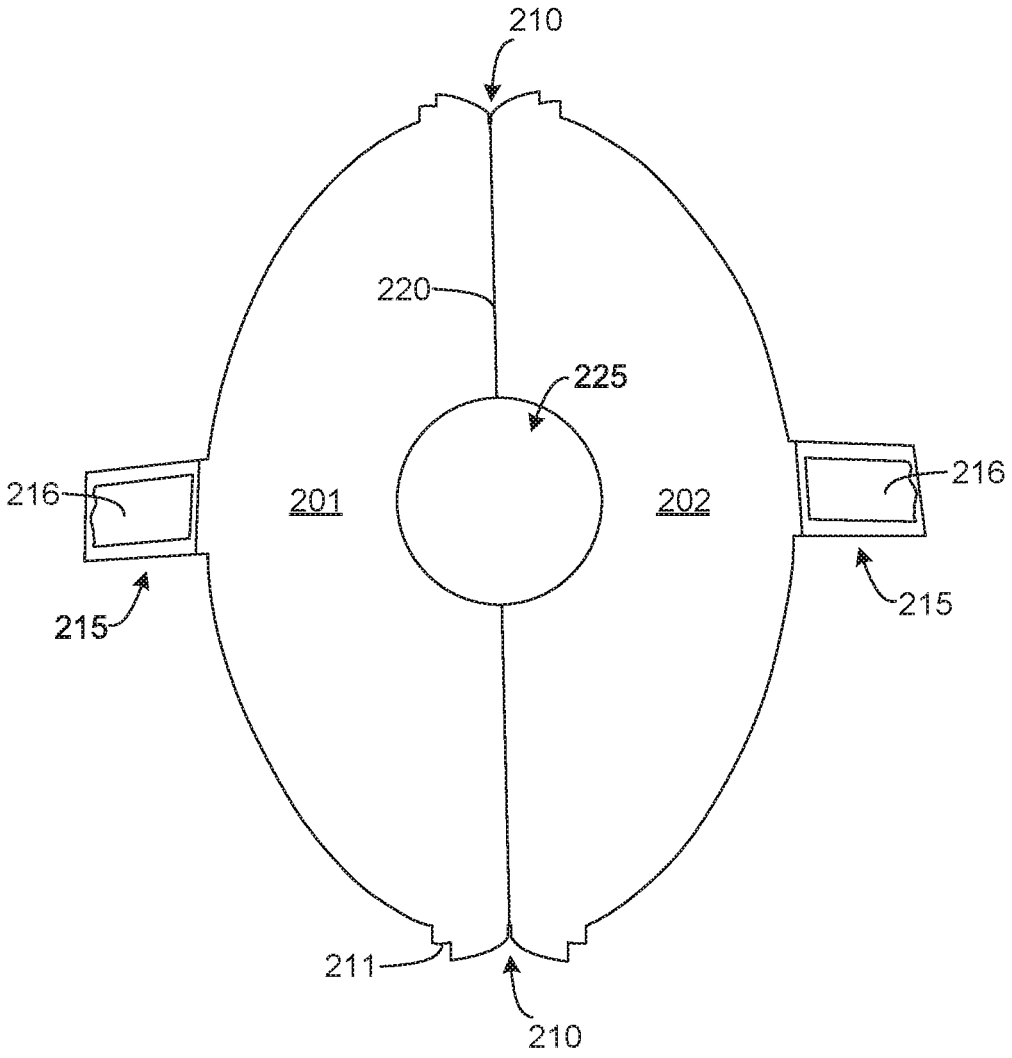
FIG. 5 is a top view of the support member or former of FIG. 2 in accord with at least some aspects of the concepts disclosed herein.

FIGS. 2 and 5 show an example wherein a support member 200 includes tabs 215 centrally disposed along a longitudinal axis, or major axis, of the support member. These tabs 215 are provided to facilitate additional points of connection between the support member 200 and the sheets 120*a*, 120*b*. In particular, an adhesive or an adhesive member 216 (see FIG. 5) is provided on the tab 215, on the respective sheets 120*a*, 120*b*, or on both the tab 215 and the respective sheets 120*a*, 120*b*, to securely couple the support member to the sheets 120*a*, 120*b*. Whereas the top view of the support member 200 of FIG. 5 shows the tabs 215 extending outwardly therefrom, upon installation of the support member into the shroud 120, the tabs are rotated downwardly (or optionally upwardly) to place the region bearing the adhesive member 216 in opposition to the sheets 120*a*, 120*b* to permit adhesive connection thereto, as shown in FIG. 2. In other examples, the support member is installed in the shroud 120 in the reverse orientation, with the tabs 215 being rotated upwardly to place the region bearing the adhesive member 216 in opposition to the sheets 120*a*, 120*b* to permit adhesive connection thereto. In still another example, one or more support members 200 are installed in the shroud 120 in a first orientation and one or more support members 200 are installed in the shroud 120 in a second orientation different from the first orientation. For example, a shroud 120 includes a first segment having a first support member 200 in the orientation depicted in FIG. 2, and a second segment having a second support member 200 reversed with respect to the first support member.

While only two tabs 215 are shown in the example of FIG. 2 and FIG. 5, the present concepts contemplate inclusion of additional tabs or lateral connection points between the support member 200 and the sheets 120*a*, 120*b*. While a hole or opening 225 is shown to be provided in the support member 200 (see, e.g., FIG. 5), such as to minimize weight or to facilitate stowing of the shroud 120, the opening is omitted in other aspects of the present concepts. Further, in other examples, the opening 225 could comprise an opening having a different shape (e.g., an ovoid or elliptical shape, a square, a rectangle, etc.) or multiple separate openings.

It is to be further noted that the tabs 215, in other examples, may be rotated upwardly or downwardly to connect with the shroud 120, such as via the adhesive members 216, irrespective of an orientation of, or opening direction of, the support member 200. By way of example, for the support member 200 depicted in FIGS. 4B and 4D, the support member can be reversed so that, rather than folding upwardly (e.g., a first half 201 and second half 202 rotate upwardly relative to the line of weakness 220), the support member instead folds downwardly (e.g., a first half 201 and second half 202 rotate downwardly relative to the line of weakness 220), with the tabs 215 either rotating upwardly or downwardly to connect to the shroud 120.

Figure 6:
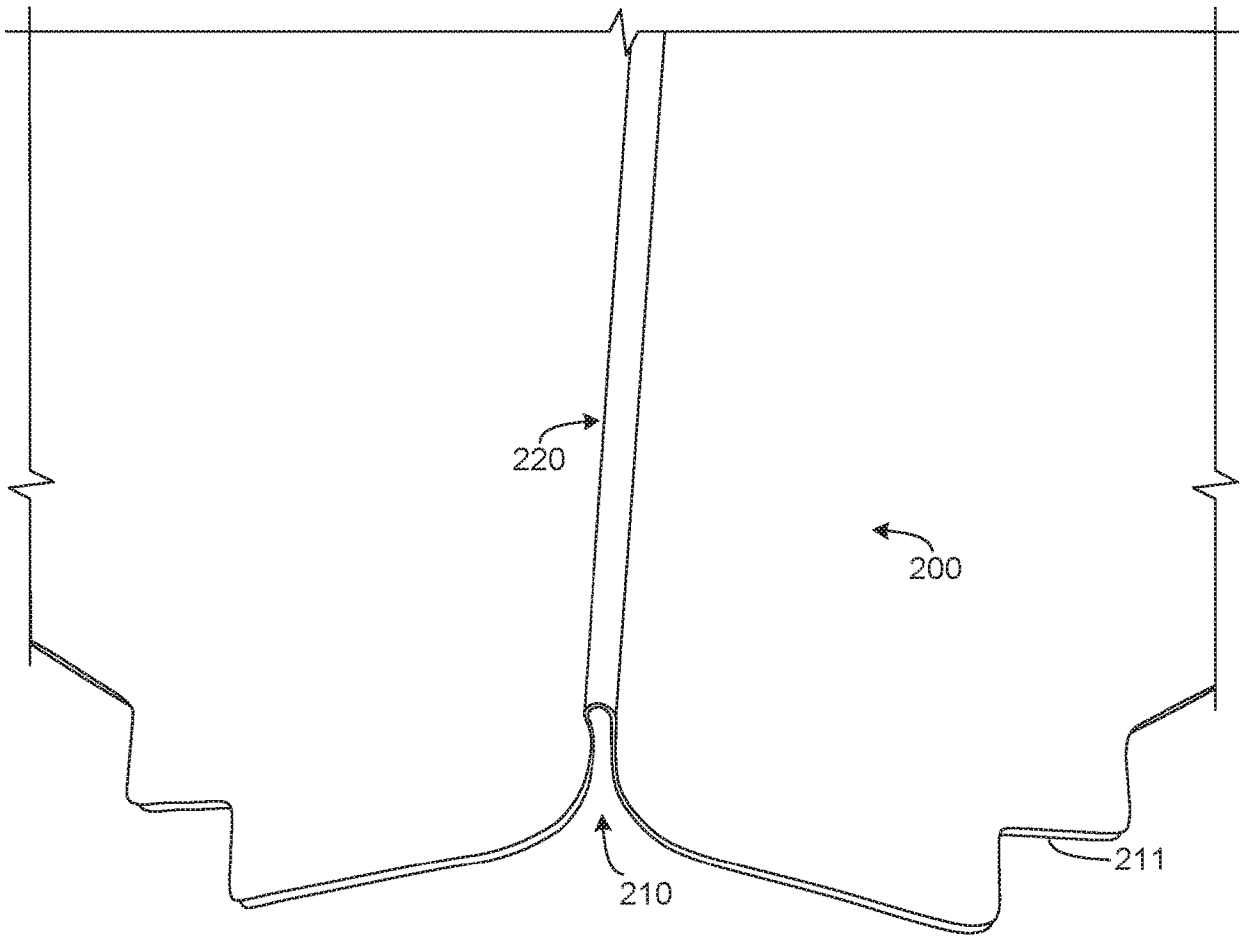
FIG. 6 is a close-up view of a portion of the support member or former of FIG. 5 in accord with at least some aspects of the concepts disclosed herein.

FIGS. 5-6 show physical features 211 of the support member 200 that are advantageously used to align the support member 200 relative to the sheets 120*a*, 120*b* during assembly of the shroud 120. By way of example, the features 211 in FIG. 6, and more specifically the surfaces that are shown to be substantially perpendicular to the line of weakness 220 of the support member, are aligned with the markings 212 in FIG. 8(*a*), to facilitate alignment of the support member 200. In other examples, in lieu of or in additional to the physical features 211, graphical elements are used on the support member 200 and/or sheets 120*a*, 120*b*, to facilitate alignment of the support member 200. As one example, markings (e.g., lines, shaded or colored rectangle, etc.) could be applied to the sheets 120*a*, 120*b* in locations corresponding to placement locations for the tabs 215.

Additional contact points between the support member 200 and the sheets 120*a*, 120*b* are provided, inter alia, via one or more slot(s) 210. FIG. 6 shows a close up view of one exemplary configuration of a slot 210 in one example of a support member 200. The slot 210 is centrally disposed along a major axis of the support member, as is the line of weakness 220, and is disposed to matingly engage the joints 130 of the shroud 120. As noted above, in the illustrated example, the first and second joints 130 formed by flaps 130*a*, 130*b* of the first and second sheets 120*a*, 120*b* project inwardly into an interior volume of the shroud 120, such as is shown in FIGS. 2-3. These joints 130 engage correspondingly dimensioned slots 210 in the support member 200. Optionally, as shown in FIG. 7(*a*), the flaps 130*a*, 130*b* and joints 130 defined thereby comprise horizontal notches 136 dimensioned to receive a thickness of the support member 200 to enable not only engagement between the joints 130 and slots 210, but also to enable overlap between the joints 130 and the support member 200 via interlocking notches.

In the example, the configuration of the inwardly projecting joints 130 and the support member 200 provides sufficient structural rigidity to enable the erected shroud 120 to maintain its deployed shape, while also sufficing to stop further inward, transverse travel of the joints 130 (i.e., axial relative to the longitudinal axis of the shroud 120) toward one another. Concurrently, whereas the support member 200 functions as a stop preventing inward, transverse travel of the joints 130 toward one another following full engagement of the joints 130 with the slots 210 of the support member 200, the support member line of weakness 220 enables one half 201 of the support member 200 to rotate about this line of weakness 220 relative to the other half 202 of the support member 200 in response to transverse forces applied to generally center portions of the shroud 120 faces (e.g., left-to-right inward force applied to the left sheet 120*a* and right-to-left inward force applied to right sheet 120*b* in FIG. 1, etc.). Thus, the line of weakness 220 facilitates movement of the erectable display 100 between a deployed position and a folded position.

FIGS. 4(*a*)-4(*f*) illustrate different aspects of an example of erecting an erectable display 100, from a substantially flat initial state (FIG. 4(*a*)) to an erected state (FIGS. 1, 4(*f*)), in accord with at least some aspects of the concepts disclosed herein. FIG. 4(*a*) shows a stowed or folded erectable display 100. FIG. 4(*b*) shows a state in which the erectable display 100 is partially unfolded, with a top segment of the display showing not only the first sheet 120*a* and second sheet 120*b* forming the shroud 120, but also the mostly folded support member 200 disposed within the top segment. FIG. 4(*c*) shows a side view of approximately the state shown in FIG. 4(*b*), such view emphasizing the stacking arrangement of the different segments of the erectable display 100 onto one another when in the stowed or folded state. Each of the segments 121-124 is hinged, through the various lines of weakness, so that each segment folds upon the underlying segment.

FIG. 4(*d*) shows another view of an interior of the topmost segment 121, depicting the first sheet 120*a* and second sheet 120*b*, which form the shroud 120, as well as the mostly folded support member 200 disposed within the top segment. It is to be noted that, in the folded state, before the forced curvature of the sheets 120*a*, 120*b* by the unfolded support member 200, the joints 130 are spaced apart from and disengaged from the support member.

In general, after the assembled display 100 is unfolded, but still in a substantially flat state, the user may gently squeeze the sides of the display along the joints to bow the sheets 120*a*, 120*b* outwardly to help the display take shape. Outward movement of the sheets 120*a*, 120*b* pulls on the attached tabs 215 of the support member 200, causing opening of the support member (FIGS. 4(*d*)-4(*e*)). FIG. 4(*e*) shows a further stage of progression of the deployment of the erectable display 100, with the sheets 120*a*, 120*b* assuming a greater degree of curvature and a further unfolding of the support member 200 about the line of weakness 220. The outward distortion of center portions of the sheets 120*a*, 120*b* causes an inward movement of the joints 130 toward the support member. FIG. 4(*f*) shows the deployed state of the top segment 121 of FIGS. 4(*a*)-4(*e*), with the support member 200 being fully unfolded about the line of weakness 220 into a substantially planar orientation, the sheets 120*a*, 120*b* being biased outwardly to the fullest extent by the support member 200 and causing inward movement of the joints 130 into engagement with the slots 210 of the support member 200. In the state depicted in FIG. 4(*f*), the joints 130, support member 200, and sheets 120*a*, 120*b* are static and locked in place.

To the extent that the notches 136 of the joints 130 are not properly aligned to engage with a thickness of the support member 200, or the joints 130 are not properly aligned to engage with the slot 210 of the support member 200, a slight manual biasing of the support member and/or flaps in appropriate directions can easily correct any potential misalignment.

The erecting processing of FIGS. 4(*a*)-4(*f*), resulting in the erected state shown in FIG. 1, can be readily reversed to stow the shroud by the user gently squeezing the sides of the display along center portions of the faces of the sheets 120*a*, 120*b* as noted above (e.g., left-to-right inward force applied to the left sheet 120*a* and right-to-left inward force applied to right sheet 120*b* in FIG. 1, etc.) to inwardly deform the curvilinear aspect of the erected sheets 120*a*, 120*b*, and, via the connection between the tabs 215 and the sheets 120*a*, 120*b*, to cause a corresponding rotation of the support member 200 about its line of weakness 220. At the same time, the joints 130 formed by the flaps 130*a*, 130*b* move out of engagement with and move away from the support member slots 210. In the example illustrated in the figures, this motion continues until the support member first half 201 is folded over the second half 202, achieving a folded state, at which point the tubular shroud 120 is itself in a substantially flattened state. The flattened shroud 120 is then further foldable about the lines of weakness formed between the various segments (e.g., 121-124) to achieve the folded state shown in FIG. 4(*a*).

In lieu of, or in combination with, the squeezing the sides of the display along center portions of the faces of the sheets 120*a*, 120*b* to initiate folding of the shroud 120 for stowage, the user gently pulls or pushes on opening 225, as appropriate to the axis of rotation of support member 200 line of weakness 200 and an orientation of the support member in the shroud. This will cause the forces to be applied to the sheets 120*a*, 120*b* through the tabs 215 connected thereto.

In other aspects of the present concepts, the support member(s) 200 are substantially planar, do not have a line of weakness 220, and are connected to only one sheet (e.g., 120*a*) via one or more tabs (e.g., 215) to permit rotation of the entire support member(s) 200 relative thereto. The support member(s) 200 can then be sequentially deployed or collapsed manually by rotation of the support member(s) 200 into place until the support member(s) 200 locks into place relative to one or more corresponding features of the sheets 120*a*, 120*b*, whether taken alone or in combination (e.g., joint 130). In one configuration, a plurality of support members 200 are ganged together via one or more connecting elements (e.g., cord, ribbon, string, bar, etc.) so that a tensile force pulling on an exposed end of one connecting element causes either simultaneous or sequential movement of the support members into a deployed state (e.g., see FIG. 4(*f*)). In another configuration there is a top support member 200 and a bottom support member that are not operably coupled to each other but are both separately deployable and manually adjusted when needed.

FIGS. 7(*a*)-7(*b*) are top views of an example of an erected erectable display 100, showing an interior volume defined by the shroud 120, which comprises sheets 120*a*, 120*b*. Line of weakness 150 are shown between the segments of the shroud 120. In a distal portion, a support member 200 is shown and, in a proximal portion, a joint 130 and a connection member 140 is shown, which connects flaps 130*a*, 130*b* to form the joint.

FIGS. 8(*a*)-8(*c*) illustrate an example of construction of an example of an erectable display 100 in accord with at least some aspects of the concepts disclosed herein. This method includes, as shown in FIG. 8(*a*), disposing a first sheet 120*a* having a first lateral end bearing flap 130*a* and a second lateral end bearing flap 130*a* adjacent to a second sheet 120*b* having a first lateral end bearing flap 130*b* and a second lateral end bearing flap 130*b*. FIGS. 8(*a*)-8(*c*) also collectively show features 131 (e.g., slits, etc.), notches 136 in the flaps 130*a*, 130*b*, and lines of weakness 150*a*, 150*b* between adjacent segments, as described above, and as shown in FIGS. 7(*a*)-7(*b*). The method includes the act of connecting the first lateral end of the first sheet 120*a* to the adjacent first lateral end of the second sheet 120*b* to form a first joint 130, as is shown in FIG. 8(*a*). The method further includes the act of connecting the second lateral end of the first sheet 120*a* to the second lateral end of the second sheet 120*b* to form a second joint 130, as is shown generally in FIGS. 8(*b*)-8(*c*), with FIG. 8(*b*) showing that the sheet 120*b* is being folded over the first sheet 120*a* to place the free flaps 130*b* of sheet 120*b* adjacent the free flaps 130*a* of sheet 120*a*. So positioned, the free flaps 130*a*, 130*b* may then be connected using the connection member(s) 140. In the example shown in FIG. 8(*c*), a single resilient connection member 140 is passed through a first feature 131 (e.g., slits) formed in one portion of the flaps 130*a*, 130*b* and a second feature 131' (e.g., a hole or eyelet) formed in another portion of the flaps 130*a*, 130*b*. Thus, different features are optionally provided at different portions of the flaps to facilitate connection of the flaps.

The method further includes the act of disposing at least one movable support member 200 between the first sheet 120*a* and the second sheet 120*b* to extend between the first joint 130 and the second joint 130 (see, e.g., FIG. 2). In this example method, the support member 200 is movable from a first position corresponding to a display apparatus stowed state (see, e.g., FIG. 4(*a*)) to a second position corresponding to a display apparatus erected state (see, e.g., FIG. 1).

The method of forming the display apparatus further includes the act of deploying the display apparatus 100 by moving the first joint 130 toward the second joint 130 to move the support member from the first position (e.g., folded) to the second position (e.g., substantially planar) and transition the display apparatus 100 from the stowed state (see, e.g., FIG. 4(*a*)) to the erected state (see, e.g., FIG. 1). Likewise, the method of forming the display apparatus 100 includes the act of stowing the display apparatus 100 by moving the first joint 130 away from the second joint 130 to move the support member 200 from the second position (e.g., substantially planar) to the first position (e.g., folded) and transition the display apparatus 100 from the erected state (see, e.g., FIG. 1) to the stowed state (see, e.g., FIG. 4(*a*)).

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A display apparatus, comprising:

a shroud including a first sheet and a second sheet disposed in opposition to one another, the first sheet and the second sheet being connected to one another at a first end by a first joint and at a second end by a second joint; and a support member disposed between the first sheet and the second sheet and between the first joint and the second joint, the support member being configured to outwardly bias the first sheet and the second sheet to cause the shroud to assume a curvilinear cross-sectional shape along at least a portion of a longitudinal axis of the shroud, the support member including a line of weakness extending along the support member between the first joint to the second joint and defining a first half and a second half of the support member, wherein the display apparatus has a first state in which the first half and the second half of the support member are folded onto one another about an axis of rotation defined by the line of weakness, and wherein the display apparatus has a second state in which the first half and the second half of the support member are unfolded about the axis of rotation to place the first half and the second half of the support member into a substantially planar orientation, the first half and the second half of the support member being releasably locked into the substantially planar orientation by at least one of a notch of the first joint or a notch of the second joint.

2. The display apparatus of claim 1, wherein the support member includes at least one of an ovoid, elliptical or oblong shape.

3. The display apparatus of claim 1,
wherein the first sheet and the second sheet are coupled to the support member.

4. The display apparatus of claim 3,
wherein the first sheet and the second sheet are coupled to the support member by adhesives.

5. The display apparatus of claim 4,
wherein the adhesives are applied to at least one of the first sheet, the second sheet, or one or more tabs extending from the support member.

6. The display apparatus of claim 1,
wherein the support member includes a first tab connecting to the first sheet by a first adhesive connection and a second tab connecting to the second sheet by a second adhesive connection.

7. The display apparatus of claim 1,
wherein at least one of the first joint or the second joint are formed by flaps formed at corresponding opposing lateral edges of the first sheet and the second sheet, the flaps folding inwardly to project into an interior volume of the shroud,
wherein the flaps engage correspondingly dimensioned slots in the support member, and
wherein engagement of the inwardly projecting flaps of the at least one of the first joint or the second joint with the support member stops further inward transverse travel of the first joint and the second joint relative to the longitudinal axis of the shroud.

8. The display apparatus of claim 1,
wherein the support member is movable between the first state in which the support member does not outwardly bias center portions of the first sheet and the second sheet from one another and the second state in which the support member outwardly biases central portions of the first sheet and the second sheet away from one another along at least a portion of the longitudinal axis of the shroud.

9. The display apparatus of claim 8,
wherein compressive forces applied to the center portions of the first sheet and the second sheet are directed along a minor axis of the support member to cause the support member to rotate about a major axis of the support member to transition the support member from the second state to the first state.

10. The display apparatus of claim 9,
wherein compressive forces applied to the center portions of the first sheet and the second sheet cause outward movement of the first joint and the second joint away from the support member and out of engagement therewith.

11. The display apparatus of claim 1,
wherein the first sheet and the second sheet each include one or more lines of weakness transverse to the longitudinal axis, and
wherein the shroud is foldable about the one or more lines of weakness.

12. The display apparatus of claim 1, further including:
a plurality of support members disposed between the first sheet and the second sheet and between the first joint and the second joint along the longitudinal axis of the shroud, the plurality of support members being configured to outwardly bias at least central portions of the first sheet and the second sheet away from one another along the longitudinal axis of the shroud.

13. The display apparatus of claim 12, wherein each of the plurality of support members have an at least substantially similar ovoid, elliptical or oblong shape.

14. A method of forming a display apparatus, comprising:
disposing a first sheet having a first lateral end and a second lateral end adjacent to a second sheet having a third lateral end and a fourth lateral end;
connecting the first lateral end of the first sheet to the third lateral end of the second sheet to form a first joint;
connecting the second lateral end of the first sheet to the fourth lateral end of the second sheet to form a second joint; and
disposing a movable support member between the first sheet and the second sheet to extend between the first joint and the second joint, the movable support member including a first half and a second half,
wherein the movable support member is movable between a first position corresponding to a display apparatus stowed state to a second position corresponding to a display apparatus erected state, the first half and the second half being releasably locked into a substantially planar orientation by at least one of a notch of the first joint or a notch of the second joint in the display apparatus erected state.

15. The method of forming the display apparatus of claim 14, further including:
deploying the display apparatus by moving the first joint toward the second joint to move the movable support member from the first position to the second position and transition the display apparatus from the stowed state to the erected state.

16. The method of forming the display apparatus of claim 15, further including:
stowing the display apparatus by moving the first joint away from the second joint to move the movable support member from the second position to the first position and transition the display apparatus from the erected state to the stowed state.

* * * * *